US011391456B2

(12) United States Patent
Jacobson

(10) Patent No.: US 11,391,456 B2
(45) Date of Patent: Jul. 19, 2022

(54) HANDLE ADAPTER ASSEMBLY INCLUDING A LIGHT ASSEMBLY

(71) Applicant: Nova Wildcat Shur-Line, LLC, St. Francis, WI (US)

(72) Inventor: John Jacobson, Mequon, WI (US)

(73) Assignee: NOVA WILDCAT SHUR-LINE, LLC, St. Francis, WI (US)

( * ) Notice: Subject to any disclaimer, the term of this patent is extended or adjusted under 35 U.S.C. 154(b) by 0 days.

(21) Appl. No.: 17/018,752

(22) Filed: Sep. 11, 2020

(65) Prior Publication Data

US 2022/0082247 A1 Mar. 17, 2022

(51) Int. Cl.

| | |
|---|---|
| ***F21V 33/00*** | (2006.01) |
| ***B05C 17/02*** | (2006.01) |
| ***F21V 23/00*** | (2015.01) |
| ***F21L 4/00*** | (2006.01) |
| ***F21V 23/06*** | (2006.01) |
| *F21Y 115/10* | (2016.01) |

(52) U.S. Cl.

CPC ..... *F21V 33/0084* (2013.01); *B05C 17/0205* (2013.01); *F21L 4/00* (2013.01); *F21V 23/005* (2013.01); *F21V 23/06* (2013.01); *F21Y 2115/10* (2016.08)

(58) Field of Classification Search

CPC .... F21V 33/0084; F21V 23/005; F21V 23/06; F21L 4/00; B05C 17/0205

See application file for complete search history.

(56) References Cited

U.S. PATENT DOCUMENTS

| | | | |
|---|---|---|---|
| 3,370,356 | A | 2/1968 | Jend |
| 4,348,715 | A | 9/1982 | Christensen et al. |
| 5,644,864 | A | 7/1997 | Kelly |
| 5,820,249 | A | 10/1998 | Walsten et al. |
| 5,826,968 | A | 10/1998 | Brantley et al. |
| 5,882,103 | A | 3/1999 | Brantley et al. |
| 6,092,907 | A | 1/2000 | Brantley et al. |
| 6,116,747 | A | 9/2000 | Grawemeyer et al. |

(Continued)

FOREIGN PATENT DOCUMENTS

| | | | |
|---|---|---|---|
| CA | 2884023 | A1 | 9/2016 |
| CN | 202288164 | U | 7/2012 |

(Continued)

OTHER PUBLICATIONS

English translation of Xie CN-203223791-U, published 2013 (Year: 2013).*

*Primary Examiner* — Evan P Dzierzynski

(74) *Attorney, Agent, or Firm* — Michael Best & Friedrich LLP

(57) ABSTRACT

A handle adapter assembly is provided for attaching to a paint applicator. The handle adapter assembly includes a housing having a first end and a second end opposite the first end. The housing includes a first connector positioned at the first end. The first connector is configured to attach to the paint applicator. The housing also includes an outer surface extending between the first end and the second end. One or more light sources is supported by the housing. A power source is supported by the housing. The power source is electrically connected to the one or more light sources. A bumper member is supported by the housing. The bumper member extends outwardly beyond the outer surface of the housing.

20 Claims, 13 Drawing Sheets

(56) References Cited

U.S. PATENT DOCUMENTS

| | | | | |
|---|---|---|---|---|
| 6,454,428 | B1 | 9/2002 | Bruzon | |
| 6,805,207 | B2 * | 10/2004 | Hagan | B25B 21/00 173/162.1 |
| 6,814,470 | B2 | 11/2004 | Rizkin et al. | |
| 6,840,652 | B1 | 1/2005 | Hymer | |
| 7,001,037 | B1 | 2/2006 | Shiao | |
| 7,178,934 | B2 * | 2/2007 | McInnis | F21V 19/04 362/109 |
| 7,628,513 | B2 | 12/2009 | Chiu | |
| 7,641,364 | B2 | 1/2010 | Abbondanzio et al. | |
| 7,775,677 | B2 | 8/2010 | Yu | |
| 8,162,363 | B2 | 4/2012 | Wang | |
| D662,116 | S | 6/2012 | Harden et al. | |
| 8,550,516 | B2 | 10/2013 | Best | |
| 9,062,834 | B2 | 6/2015 | Rennecker | |
| 9,238,246 | B2 | 1/2016 | Surratt et al. | |
| 9,851,060 | B2 | 12/2017 | Pathy | |
| 10,302,284 | B2 | 5/2019 | Ammer | |
| 2006/0147256 | A1 * | 7/2006 | Richardson | B25G 1/06 403/91 |
| 2006/0249554 | A1 * | 11/2006 | Butzen | B25C 1/008 227/130 |
| 2008/0266845 | A1 | 10/2008 | Wu et al. | |
| 2011/0012382 | A1 | 1/2011 | Wang | |
| 2012/0170263 | A1 | 7/2012 | Rodriguez | |
| 2015/0029694 | A1 * | 1/2015 | Cheng | H01R 31/06 362/95 |
| 2015/0251210 | A1 * | 9/2015 | Surratt | F21V 33/0084 15/105 |
| 2016/0010849 | A1 | 1/2016 | Snellenberger | |
| 2017/0071327 | A1 * | 3/2017 | Fleischer | F21V 33/00 |
| 2018/0135814 | A1 | 5/2018 | Pathy | |

FOREIGN PATENT DOCUMENTS

| | | | |
|---|---|---|---|
| CN | 203223791 | U * | 10/2013 |
| CN | 104433184 | A | 3/2015 |
| WO | WO2018/076315 | A1 | 5/2018 |
| WO | WO2019/113687 | A1 | 6/2019 |

* cited by examiner

HANDLE ADAPTER ASSEMBLY INCLUDING A LIGHT ASSEMBLY

BACKGROUND

The present invention relates to a handle adapter assembly for attachment to a paint roller and, in particular, to a handle adapter assembly with a light assembly.

Paint rollers are used for painting on a large surface area, such as on walls, ceilings, floors, etc. The paint roller may be coupled to an extension member (e.g., pole) by a handle adapter for extending a range of the paint roller to facilitate painting of large surface areas and/or allowing a user to reach a portion of the surface area that was previously out of reach.

SUMMARY

In one embodiment, the invention provides a handle adapter assembly for attaching to a paint applicator. The handle adapter assembly includes a housing having a first end and a second end opposite the first end. The housing includes a first connector positioned at the first end. The first connector is configured to attach to the paint applicator. The housing also includes an outer surface extending between the first end and the second end. One or more light sources is supported by the housing. A power source is supported by the housing. The power source is electrically connected to the one or more light sources. A bumper member is supported by the housing. The bumper member extends outwardly beyond the outer surface of the housing.

In another embodiment, the invention provides a handle adapter assembly for attaching to a paint applicator. The handle adapter assembly includes a housing having a first end and a second end. The housing defines a longitudinal axis extending through the first end and the second end. The housing includes a first connector positioned at the first end. The first connector is configured to attach to the paint applicator. An annular printed circuit board is supported by the housing and positioned concentrically with the longitudinal axis. One or more LEDs is positioned on the annular printed circuit board. A power source is supported by the housing. The power source is electrically connected to the printed circuit board and to the one or more LEDs.

In yet another embodiment, the invention provides a handle adapter assembly for attaching to a paint applicator. The handle adapter assembly includes a housing having a first end and a second end. The housing defines a longitudinal axis extending through the first end and the second end. The housing includes a threaded stem portion positioned at the first end and a threaded bore portion positioned at the second end. The housing defines a cavity. One or more light sources is supported by the housing. A battery compartment assembly is supported by the housing and positioned within the cavity. The battery compartment assembly includes a battery receptacle configured to receive a battery. The battery receptacle extends along a second axis that is angled relative to the longitudinal axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
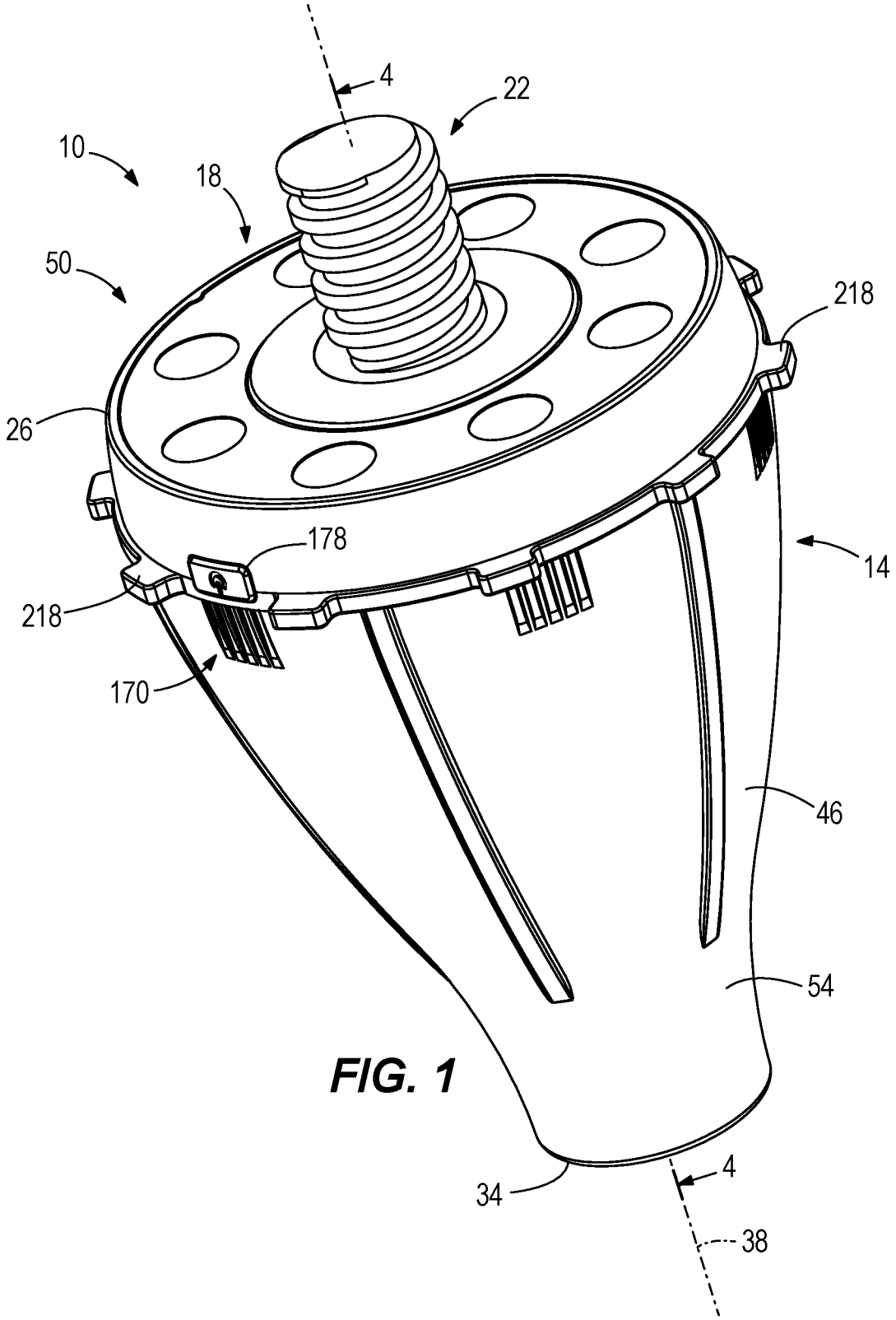
FIG. 1 is a perspective view of a handle adapter assembly according to a first embodiment.
Figure 2:
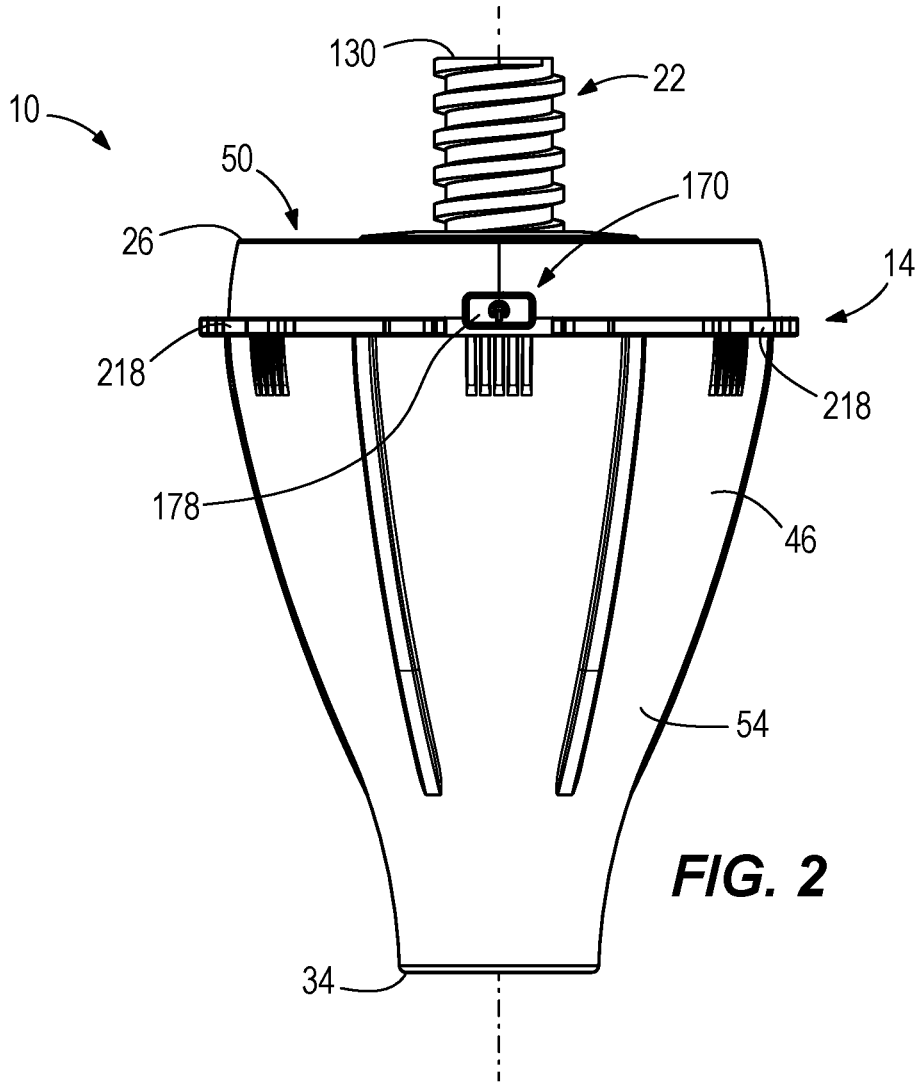
FIG. 2 is a side view of the handle adapter assembly of FIG. 1.
Figure 3:
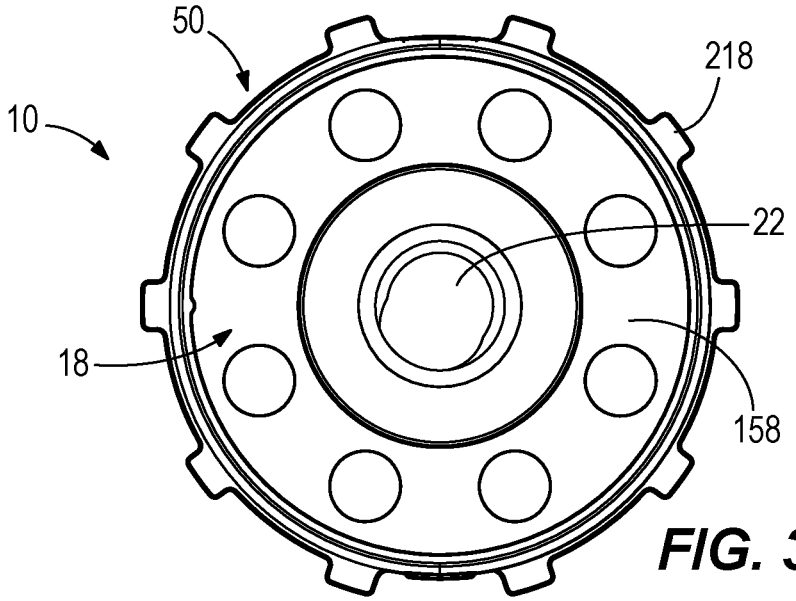
FIG. 3 is a front view of the handle adapter assembly of FIG. 1.

FIG. 1 illustrates a handle adapter assembly 10 including a housing 14 and a light assembly 18. The handle adapter assembly 10 further includes a first connector 22 positioned at a first end 26 of the housing 14 for attachment to a paint applicator (not shown) for applying a liquid (e.g., paint, primer, stain, sealant, etc.) to a surface, such as an interior wall of a building. In some embodiments, the paint applicator may be a paint roller. In other embodiments, the paint applicator may be a pad, an edger, a brush, and the like. The illustrated handle adapter assembly 10 further includes a second connector 30 (FIG. 4) positioned at a second end 34 opposite the first end 26 of the housing 14. The threaded bore portion 30 is configured for attachment to an extension member (e.g., pole 530; see FIG. 8). The illustrated handle adapter assembly 10 is particularly suited for connection to the paint applicator and extension member to facilitate painting of surfaces having large surface areas and/or areas that are out of reach of a user.

Figure 4:
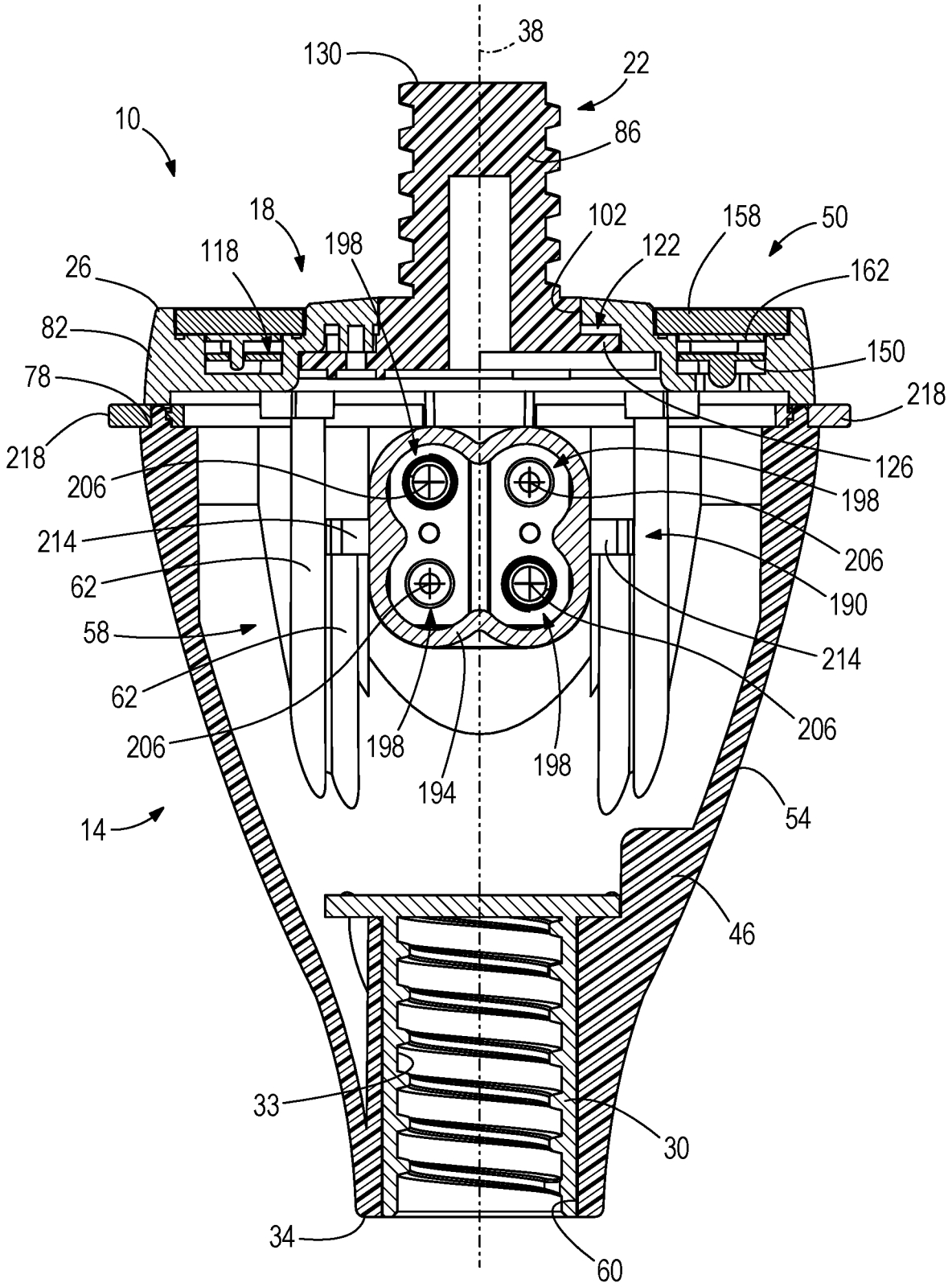
FIG. 4 is a side cross-sectional view of the handle adapter assembly of FIG. 1.

In the illustrated embodiment, the first connector 22 is a threaded stem portion, and the second connector 30 is a threaded bore portion. As illustrated in FIG. 4, the threaded stem portion 22 and the threaded bore portion 30 are separate from each other. The threaded stem portion 22 includes threads defined on an outer surface of the threaded stem portion 22. The threaded bore portion 30 includes a base portion 32, and threads defined within a bore 33 of the base portion 32. The threads of threaded stem portion 22 and the threads of the threaded bore portion 30 may have the same or different size. In some embodiments, the relative locations of the threaded stem portion 22 and the threaded bore portion 30 may be reversed (e.g., the threaded bore portion 30 may be positioned at the first end 26 of the housing 14 for attachment to the paint applicator, and the threaded stem portion 22 may be positioned at the second end 34 of the housing 14 for attachment to the extension member). In other embodiments, the handle adapter assembly 10 may include other suitable types of connectors, such as bayonet-style couplers, magnetized connectors, detent-style connectors, quick-release couplers, and the like, or may include a combination of different types of connectors.

With reference to FIGS. 1-4, the housing 14 defines a longitudinal axis 38 extending through the first end 26 and the second end 34. The housing 14 includes a body 46 and a head assembly 50. The body 46 is positioned concentrically with the longitudinal axis 38. The body 46 includes an outer surface 54 extending between proximate the first end 26 and the second end 34. The outer surface 54 is configured as a handle to be grasped by a user. In addition, the threaded stem portion 22 and the threaded bore portion 30 are positioned concentrically with the longitudinal axis 38.

Figure 5:
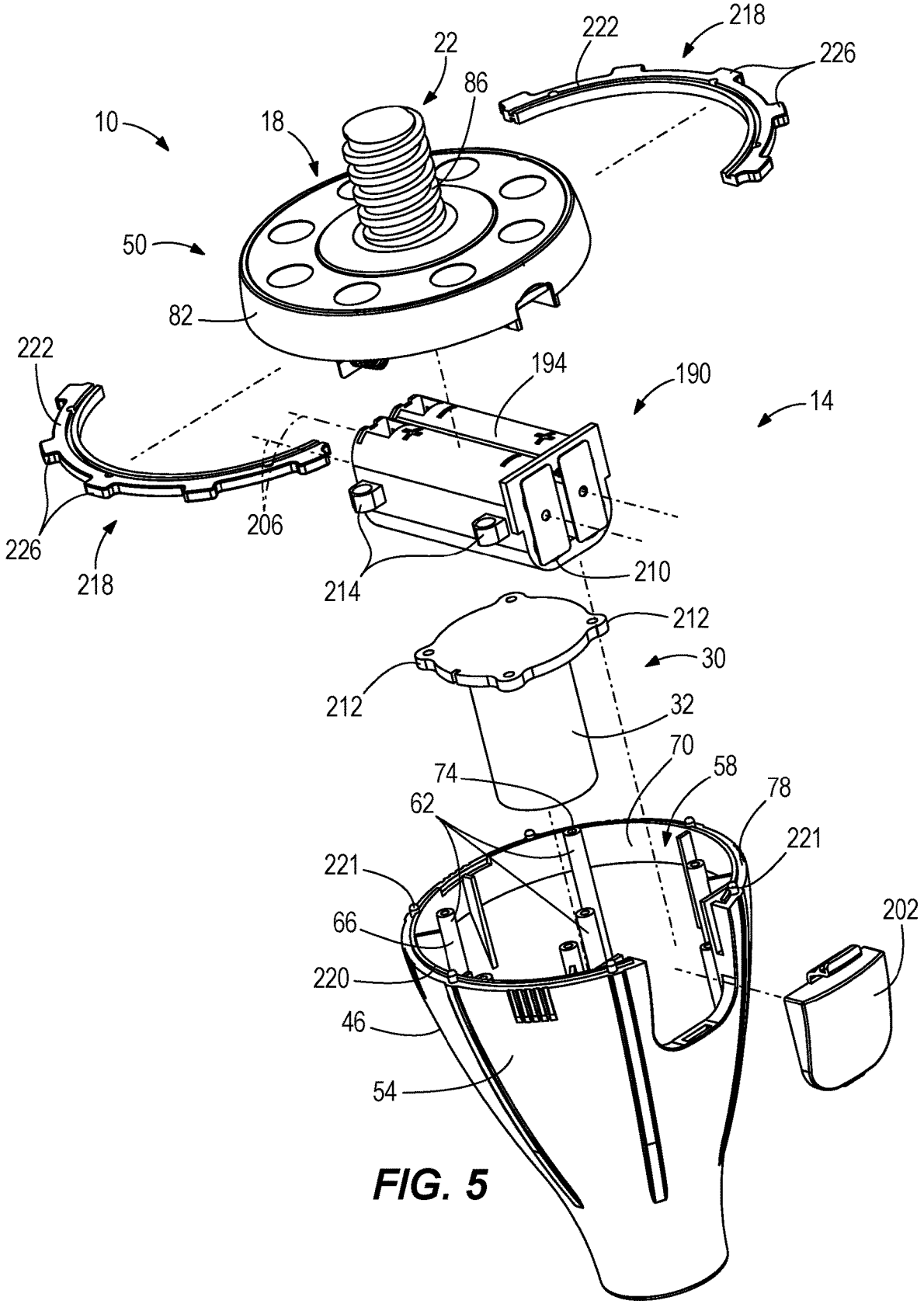
FIG. 5 is an exploded view of the handle adapter assembly of FIG. 1, illustrating a housing having a body and a head assembly.

With reference to FIGS. 4 and 5, the body 46 defines a cavity 58. The illustrated cavity 58 extends between proximate the first end 26 and the second end 34 of the housing 14. More specifically, the cavity 58 extends from an annular end surface 78 positioned at an end of the body 46 opposite the second end 34. The end surface 78 is positioned proximate the first end 26 of the housing 14. Accordingly, the cavity 58 extends between the end surface 78 and the second end 34 of the housing 14.

The threaded bore portion 30 is positioned within the cavity 58. In particular, the bore 33 of the threaded bore portion 30 is aligned with an opening 60 adjacent the second end 34 of the housing 14 (FIG. 4). An end portion of the extension member is configured to be received through the opening 60 and threaded to the threads within the bore 33 for coupling the extension member thereto.

With reference to FIGS. 4-7, the head housing 50 is coupled to the body 46 proximate the first end 26 of the housing 14 (FIG. 4). The head housing 50 includes a first, cover member 82, and a second, connection member 86 coupled to the cover member 82. In particular, the cover member 82 is configured to cover the cavity 58 of the body 46 proximate the first end 26.

The cover member 82 includes a body member 90. The body member 90 has a first side 94 and a second side 98 (FIGS. 6 and 7, respectively) located axially opposite the first side 94 relative to the longitudinal axis 38. The body member 90 defines a bore 102 extending therethrough. The bore 102 is positioned concentrically with the longitudinal axis 38. In addition, the body member 90 defines a first opening 106 extending therethrough. The first opening 106 is spaced radially outward from the bore 102 relative to the longitudinal axis 38. The body member 90 further includes a second opening 110 (FIG. 6) positioned proximate the first opening 106. The second opening 110 extends radially through an outer surface 114 of the body member 90 relative to the longitudinal axis 38.

With continued reference to FIGS. 4-7, the body member 90 further includes a first receptacle 118 and a second receptacle 122. The first receptacle 118 is positioned on the first side 94. The second receptacle 122 is positioned on the second side 98. Each of the illustrated first receptacle 118 and the second receptacle 122 has an annular shape. In addition, each of the first receptacle 118 and the second receptacle 122 is positioned radially outward of the bore 102 relative to the longitudinal axis 38. Each of the first receptacle 118 and the second receptacle 122 is positioned concentrically with the longitudinal axis 38. The first receptacle 118 is configured to receive the light assembly 18, as further discussed below.

The second receptacle 122 is configured to receive a portion of the connection member 86 of the head assembly 50 (FIG. 4). More specifically, the connection member 86 includes a base portion 126 and the threaded stem portion 22 extending therefrom. The base portion 126 is received in the second receptacle 122. The illustrated base portion 126 has a circular shape. In addition, the base portion 126 is sized to correspond to a size of the second receptacle 122.

With particular reference to FIG. 4, the threaded stem portion 22 has a length extending between the base portion 126 and an end 130 opposite the base portion 126. The threaded stem portion 22 is configured to extend through the bore 102 of the cover member 82 when the handle adapter assembly 10 is assembled together. As such, the end 130 of the threaded stem portion 22 is axially spaced from the first end 26 of the housing 14 relative to the longitudinal axis 38.

The threaded stem portion 22 includes the threads for removably coupling the handle adapter assembly 10 to the paint applicator. In one example, a handle of the paint applicator includes a threaded bore, and the threaded stem portion 22 is receivable within and threaded to the threaded bore of the handle of the paint applicator. In other embodiments, the cover member 82 and the connection member 86 may be integrated as a single piece, including the threaded stem portion 22.

Figure 6:
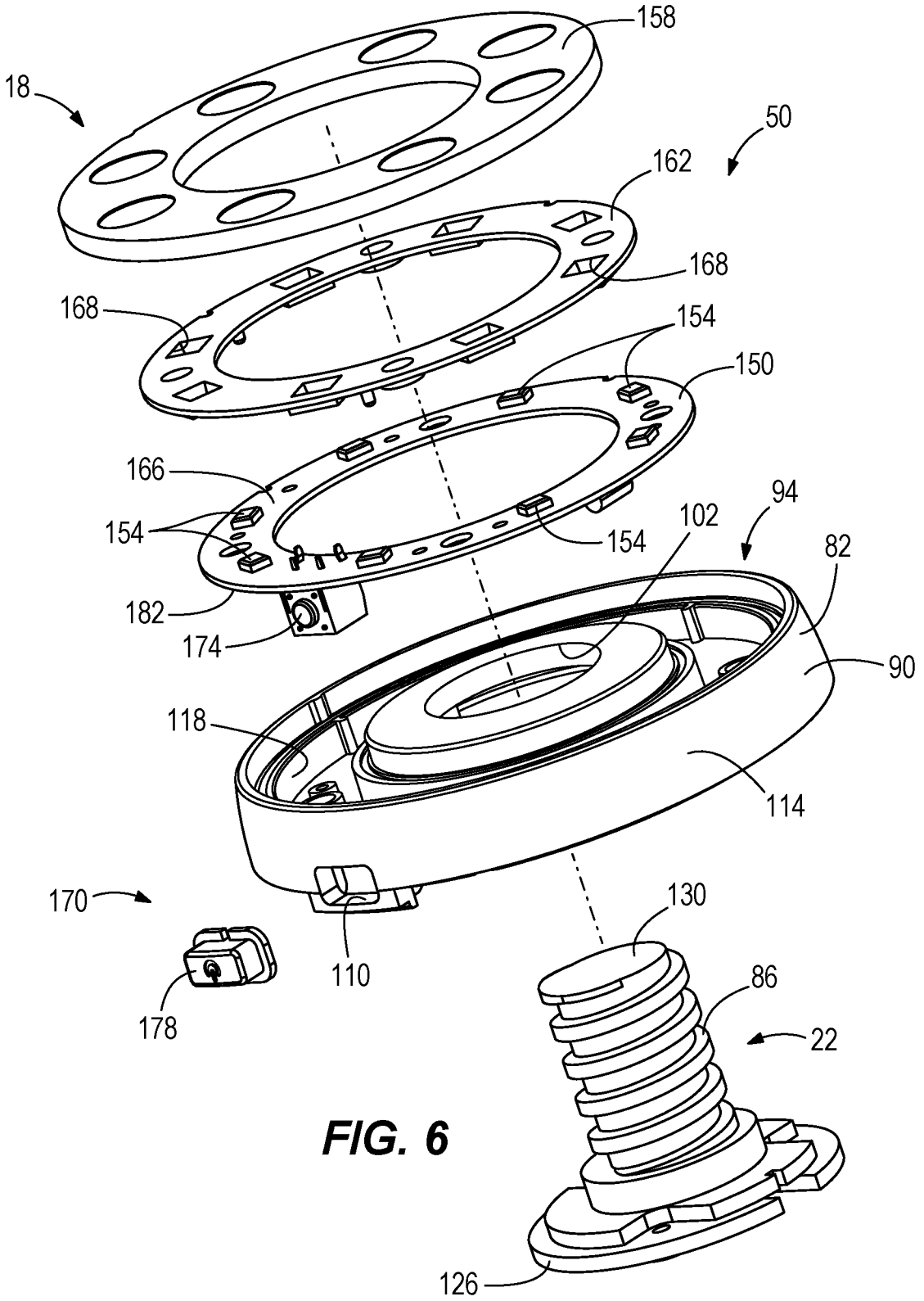
FIG. 6 is an exploded view of the head assembly of FIG. 5.

With reference to FIGS. 4 and 6, the head housing 50 includes the light assembly 18. The light assembly 18 is supported by the housing 14. The light assembly 18 includes a printed circuit board (PCB) 150, a plurality of light sources 154, and a lens member 158. The illustrated light assembly 18 further includes a cover plate member 162. The first receptacle 118 is configured to receive the light assembly 18. As shown in FIG. 6, the illustrated PCB 150 has an annular shape that is positioned concentrically with the longitudinal axis 38. Accordingly, the PCB 150 is shaped to compliment the shape of the first receptacle 118. Furthermore, the threaded stem portion 22 extends through a center of the annular PCB 150.

The light sources 154 are positioned on the PCB 150. In the illustrated embodiment, the plurality of light sources 154 includes eight light sources 154 positioned concentrically with the longitudinal axis 38. In other embodiments, the light assembly 18 may include one or more light sources 154 (two, three, etc.) positioned at any location on the PCB 150.

As illustrated in FIG. 4, each light source 154 is a light emitting diode (LED). Each light source 154 is positioned to direct light outward from the first end 26 of the housing 14. More specifically, each light source 154 is positioned to direct light in a direction parallel to the longitudinal axis 38. The PCB 150 includes a first surface 166 facing toward the paint applicator when the paint applicator is attached to the threaded stem portion 22, and each light source 154 is positioned on the first surface 166 and facing away from the first surface 166. Accordingly, the light sources 154 of the light assembly 18 are configured to direct light toward the paint applicator.

The lens member 158 of the light assembly 18 is supported by the housing 14. The lens member 158 is configured as a single piece, and is formed of transparent material. The lens member 158 has an annular shape and is positioned concentrically with the longitudinal axis 38. The lens member 158 covers the plurality of light sources 154.

With reference again to FIGS. 4 and 6, the cover plate member 162 is positioned axially between the PCB 150 and the lens member 158 relative to the longitudinal axis 38. The cover plate member 162 has an annular shape corresponding to the shape of the annular PCB 150. The cover plate member 162 includes a plurality of holes 168. Each hole 168 is configured to align with one of the light sources 154 positioned on the PCB 150. As such, each hole 168 is configured to receive the respective light source 154. The cover plate member 162 is configured to cover the first surface 166 of the PCB 150.

Figure 7:
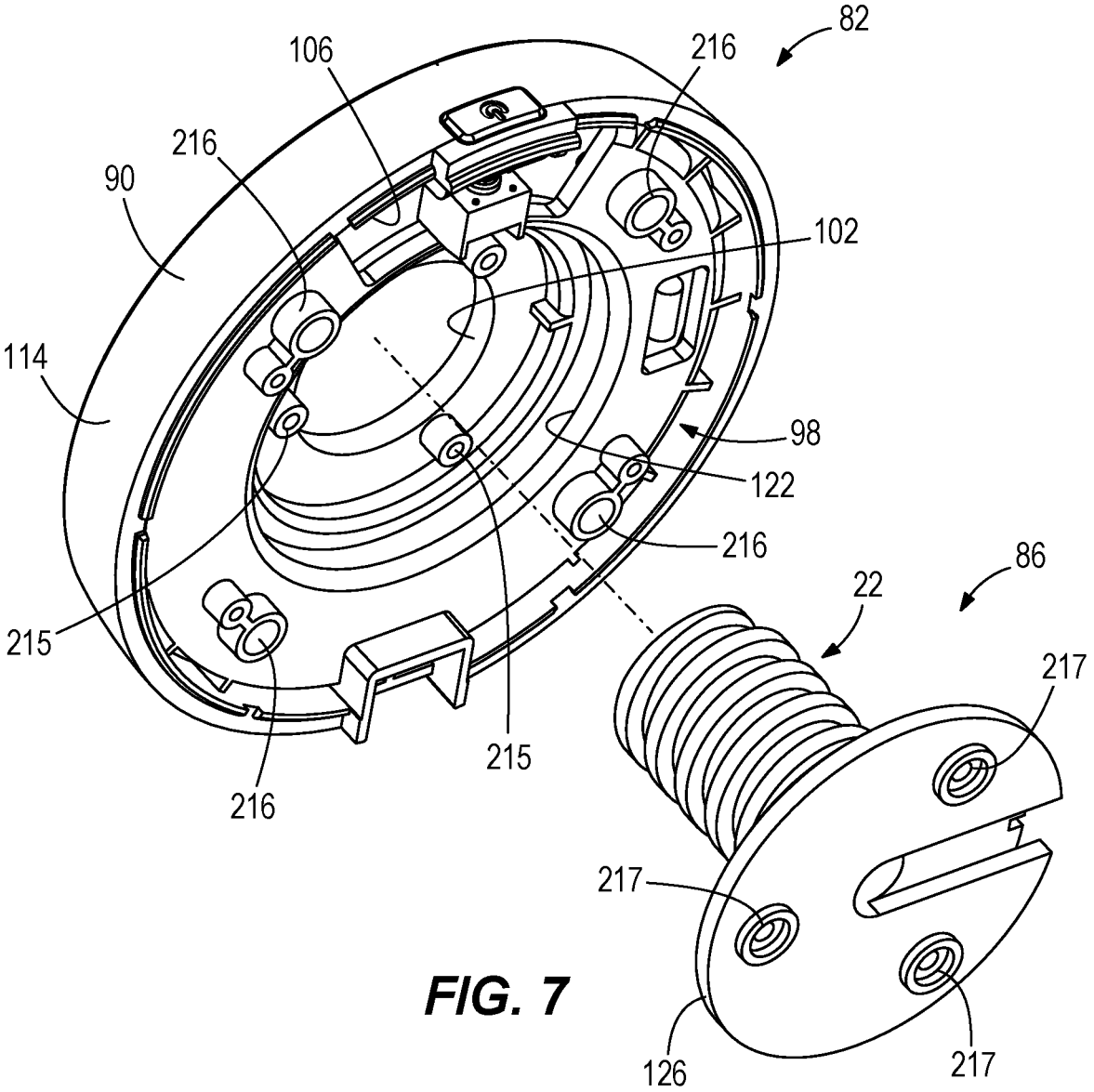
FIG. 7 is a bottom exploded view of a portion of the head assembly of FIG. 5, illustrating a cover member and a connection member of the head assembly.

With reference to FIGS. 6 and 7, the light assembly 18 further includes a switch assembly 170. The switch assembly 170 includes a switch 174 and an actuator 178. The switch 174 is mounted on the PCB 150. The illustrated switch 174 extends from a second surface 182 of the PCB 150 opposite the first surface 166. In addition, the switch 174 is configured to extend through the first opening 106 in the cover member 82. The switch 174 is electrically connected to the PCB 150 and to the plurality of light sources 154.

The actuator 178 is operatively coupled to the switch 174. The PCB 150 is positioned within the first receptacle 118 such that the switch 174 extends axially through the first opening 106 relative to the longitudinal axis 38 (e.g., downward from the frame of reference of FIG. 6), and the actuator 178 extends radially through the second opening 110. The actuator 178 is partially exposed to an exterior of the housing 14 (FIG. 1). The actuator 178 is engageable by a user for adjusting the switch assembly 170 between an on state and an off state. In the illustrated embodiment, the actuator 178 includes a pushbutton. In other embodiments, other suitable actuators may be used (e.g., a dial, a slider, etc.). In addition, in some embodiments, the actuator 178 may also cycle between different modes (e.g., high, low, etc.) of the light assembly 18, or the light assembly 18 may include a second actuator for changing modes. In further embodiments, the light assembly 18 may cycle between different modes where only subsets of the light sources 154 are turned on (e.g., all the light sources 154 are turned on, one or more of the light sources 154 are turned on, etc.).

With reference to FIGS. 4-5, the handle adapter assembly 10 further includes a battery compartment assembly 190. The battery compartment assembly 190 is supported by the housing 14. The battery compartment assembly 190 is positioned within the cavity 58. The battery compartment assembly 190 includes a housing 194 having a plurality of receptacles 198, and a door member 202. Each receptacle 198 is configured to receive a battery. The illustrated battery compartment assembly 190 includes four receptacles 198. In other embodiments, the battery compartment assembly 190 may include one or more receptacles 198.

Each receptacle 198 extends along a receptacle axis 206. Each receptacle axis 206 is angled relative to the longitudinal axis 38 of the housing 14. As such, each receptacle axis 206 intersects the longitudinal axis 38 of the housing 14. In the illustrated embodiment, each receptacle axis 206 is perpendicular to the longitudinal axis 38 (FIG. 4). In other embodiments, each receptacle axis 206 may extend at an oblique angle relative to the longitudinal axis 38.

The door member 202 (FIG. 5) is movably coupled to the housing 14 of the handle adapter assembly 10. The door member 202 is positioned adjacent one end 210 of the battery compartment assembly 190. The illustrated door member 202 forms a portion of the outer surface 54 of the housing 14. The door member 202 selectively encloses the plurality of receptacles 198 of the battery compartment assembly 190. In other embodiments, the door member 202 may be configured to selectively enclose one or more of the receptacles 198.

The battery compartment assembly 190 is electrically connected to the PCB 150 of the light assembly 18. The batteries in the battery compartment assembly 190 are configured to supply power to the plurality of light sources 154. Accordingly, the battery compartment assembly 190 may be referred to herein as a 'power source.' In other embodiments, the handle adapter assembly 10 may be configured to support another type of power source (e.g., AC power source).

The switch assembly 170 is configured to selectively control a power supply from the power source 190 to the plurality of light sources 154. As such, the switch assembly 170 is configured to selectively control the illumination of the light assembly 18.

In operation, a user may actuate the actuator 178 to turn the light assembly 18 on. The light assembly 18 may help illuminate relatively dark areas, such as corners and small spaces. By providing light sources 154 on the handle adapter assembly 10, the area around the paint applicator is better illuminated.

With reference to FIGS. 1-5, the handle adapter assembly 10 further includes a plurality of bumper members 218. Each bumper member 218 is supported by the housing 14. In addition, each bumper member 218 is configured to protrude outwardly beyond the outer surface 54 of the body 46. More specifically, the bumper members 218 protrude radially outward from the housing 14 relative to the longitudinal axis 38.

The bumper members 218 are positioned proximate the first end 26 of the housing 14 (and also proximate the light assembly 18). The bumper members 218 are secured to the body 46. In particular, the bumper members 218 are positioned to circumferentially surround the outer surface 54 of the body 46 relative to the longitudinal axis 38. In the illustrated embodiment, the bumper members 218 are positioned on the annular end surface 78 defined by the body 46 (FIG. 4). In addition, the body 46 includes a rib 220 and plurality of protrusions 221 (FIG. 5) extending from the end surface 78. The protrusions 221 are spaced equidistantly relative to the longitudinal axis 38 on the annular end surface 78. Each bumper member 218 is secured to the body 46 via the rib 220 and the protrusions 221. Furthermore, each bumper member 218 is clamped between the body 46 and the head assembly 50.

In the illustrated embodiment, the handle adapter assembly 10 includes two bumper members 218. Each of the illustrated bumper members 218 includes an arcuate body 222 and a plurality of projections 226 extending therefrom (FIG. 5). Each bumper member 218 includes five projections 226 evenly spaced along the arcuate body 222. In other embodiments, the handle adapter assembly 10 may include one or more bumper members 218, and/or each bumper member 218 may include one or more projections 226 positioned at any location along the arcuate body 222. For example, the bumper member 218 may be a single annular ring that wraps around the housing 14 and extends beyond the outer surface 54 of the body 46.

The bumper members 218 are formed of an elastic material. The bumper members 218 are configured to engage a surface when the handle adapter assembly 10 is being used to inhibit the housing 18 (which may be made of a relatively hard plastic material) from marring the surface. The bumper members 218 are also configured to dampen forces applied to handle adapter assembly 10 (e.g., such as when the handle adapter assembly 10 is dropped, etc.). Accordingly, the bumper members 218 are configured to protect the handle adapter assembly 10.

To facilitate assembly of the handle adapter assembly 10 together, with reference to FIG. 5, the handle adapter assembly 10 further includes a plurality of alignment elements 62, 212, 214, 215, 216, 217. In particular, the cavity 58 of the body includes a plurality of alignment elements 62. Each alignment element 62 is configured as a projection 66 (FIG. 5) extending from an inner surface 70 of the body 46. Each projection 66 includes a hole 74 extending therethrough.

In addition, each of the threaded bore portion 30 and the battery compartment assembly 190 includes alignment elements 212, 214 (FIG. 5), respectively. The alignment elements 212, 214 protrude outwardly from the housing 32 of the threaded bore portion 30 and the housing 194 of the battery compartment assembly 190, respectively. The alignment elements 212, 214 are configured to align with the respective alignment elements 62 within the cavity 58 of the body 46 when positioning the threaded bore portion 30 and the battery compartment assembly 190 within the cavity 58.

Furthermore, with reference to FIG. 7, the cover member 82 includes first and second alignment elements 215, 216. Each of the first alignment elements 215 and the second alignment elements 216 are positioned on the second side 98 of the cover member 82. The first alignment elements 215 are positioned within the second receptacle 122. The base portion 126 of the connection member 86 includes alignment elements 217 configured to align with the respective first alignment elements 215 on the cover member 82 when the head housing 50 is assembled together. The second alignment elements 216 are configured to align with the respective alignment elements 62 positioned within the cavity 58 of the body 46 to facilitate coupling of the head housing 50 and the body 46 together.

A fastener (not shown) may be received through the holes of each set of aligned alignment elements 62, 212, 214, 215, 216, 217. The fasteners are configured to secure the different elements (e.g., body 46, head housing 50, threaded bore portion 30, battery compartment assembly 190) of the handle adapter assembly 10 together.

FIGS. 8-17 illustrate another embodiment of a handle adapter assembly 310, with like components and features as the embodiment of the handle adapter assembly 10 shown in FIGS. 1-7 being labeled with like reference numerals plus "300." The handle adapter assembly 310 is similar to the handle adapter assembly 10 and, accordingly, the discussion of the handle adapter assembly 10 above similarly applies to the handle adapter assembly 310 and is not re-stated. Rather, only differences between the handle adapter assembly 10 and the handle adapter assembly 310 are specifically noted herein, such as differences in the head housing, the configuration of the battery compartment assembly, and the connection to the extension member.

The handle adapter assembly 310 includes a housing 314 and a threaded stem portion 322 positioned at a first end 326 of the housing 314. The housing 314 defines a longitudinal axis 338. The housing 314 includes a body 346 and a head housing 350. The body 346 defines a cavity 358.

Figure 16:
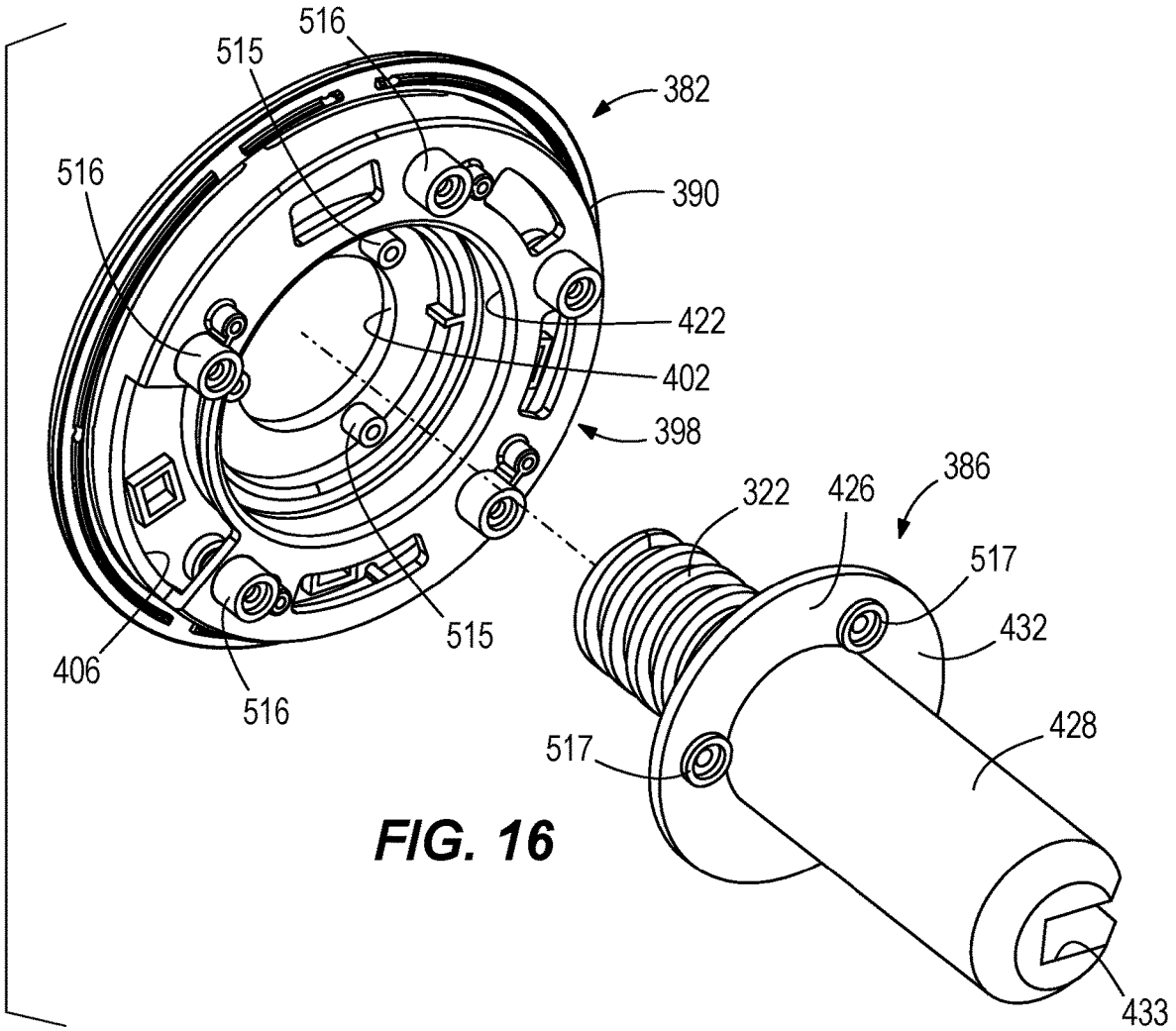
FIG. 16 is a bottom exploded view of a portion of the head assembly of FIG. 14, illustrating a cover member and a connection member of the head assembly.
Figure 17:
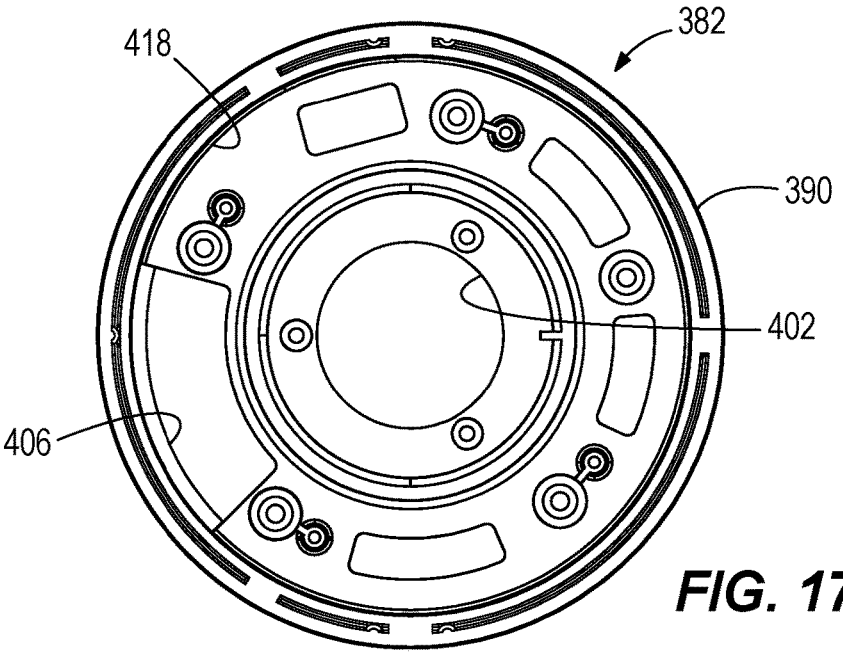
FIG. 17 is a front view of the body portion of FIG. 16.

With reference to FIG. 16, the head housing 350 includes a first, cover member 382, and a second, connection member 386 coupled to the cover member 382. The cover member 382 defines a bore 402 and a first opening 406 extending therethrough. The bore 402 is positioned concentrically with the longitudinal axis 338. The first opening 406 is positioned radially outward of the bore 402 relative to the longitudinal axis 338.

The connection member 386 includes a first, base portion 426, the second, threaded stem portion 322, and a third portion 428. The threaded stem portion 322 extends from a first side 431 of the base portion 426. The third portion 428 extends from a second side 432 of the base portion 426 opposite the first side 431. Similar to the first embodiment of the handle adapter assembly 10 of FIGS. 1-7, the threaded stem portion 322 is configured to extend through the bore 402. In addition, the threaded stem portion 322 includes threads for removably coupling the handle adapter assembly 310 to the paint applicator. The third portion 428 is received in the cavity 358 of the body 346. The third portion 428 defines a cutout 433 (FIG. 16).

Figure 10:
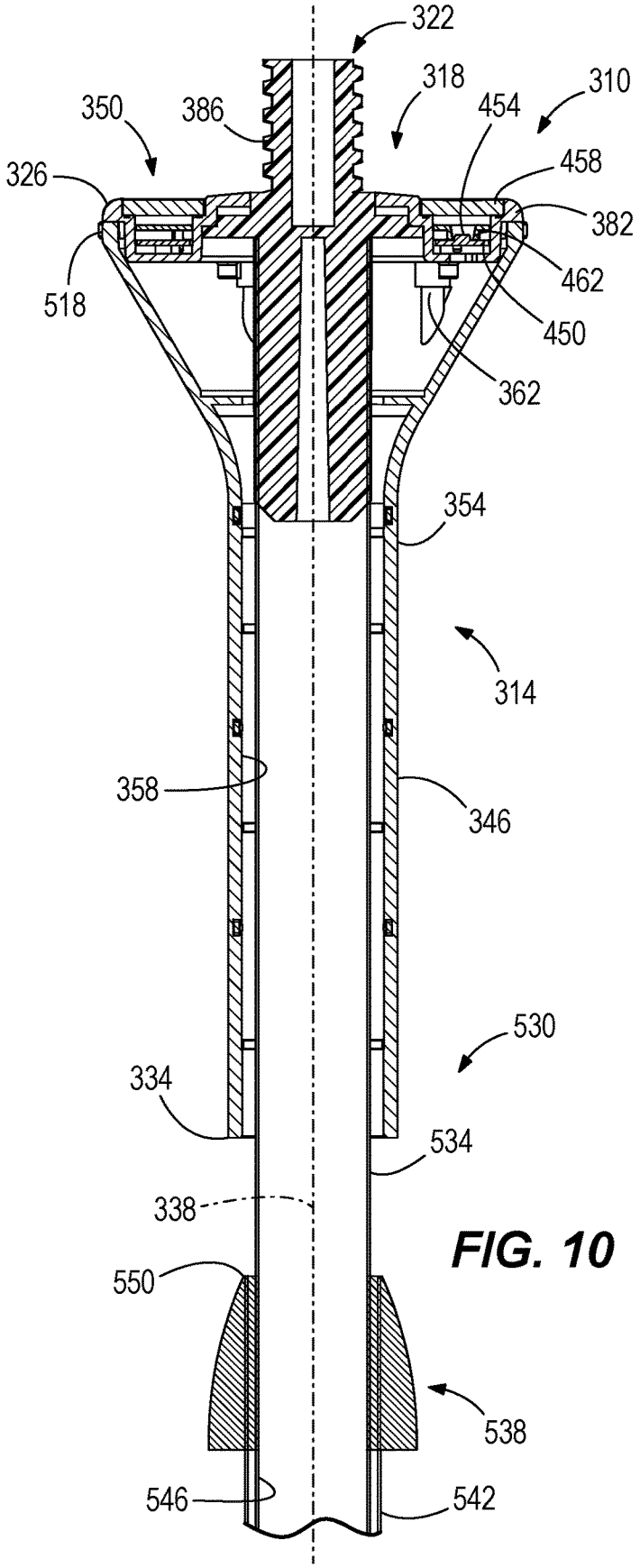
FIG. 10 is a cross-sectional view of the handle adapter assembly and a portion of the extension pole of FIG. 8.
Figure 15:
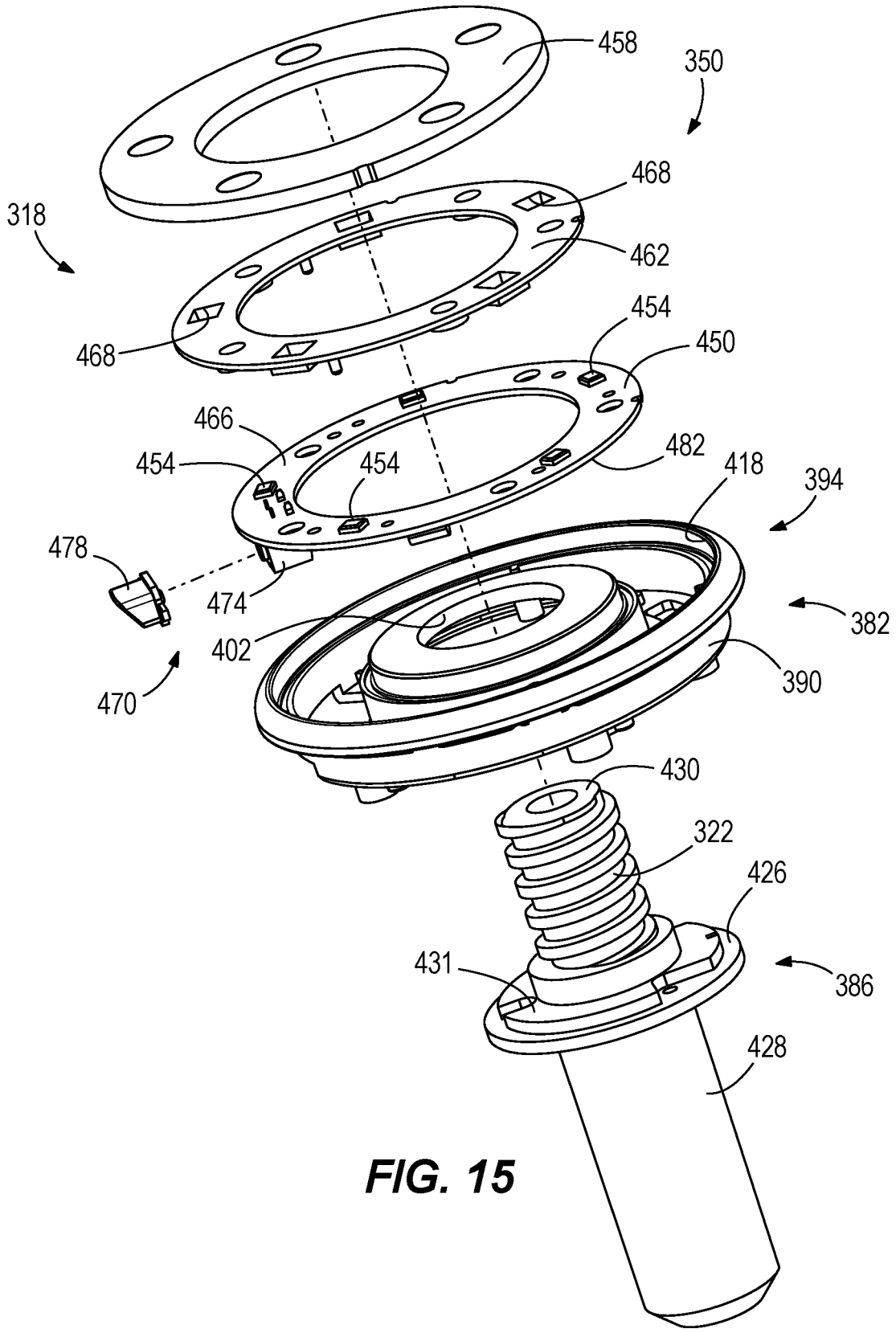
FIG. 15 is an exploded view of the head assembly of FIG. 14.

With reference to FIGS. 10 and 15, the head housing 350 further includes the light assembly 318. The light assembly 318 is supported by the housing 314. The light assembly 318 includes a PCB 450, a plurality of light sources 454 positioned on the PCB 450, and a lens member 458 covering the plurality of light sources 454. The illustrated light assembly 318 further includes a cover plate member 462 positioned between the PCB 450 and the lens member 458.

With reference to FIG. 15, the light assembly 318 further includes a switch assembly 470. The switch assembly 470 includes a switch 474 and an actuator 478. The switch 474 is supported by the PCB 450. The illustrated switch 474 extends from a surface 482 of the PCB 450. In addition, the switch 474 is configured to extend from the PCB 450 through the first opening 406 in the cover member 482. The switch 474 is electrically connected to the PCB 450 and to the plurality of light sources 454.

Figure 11:
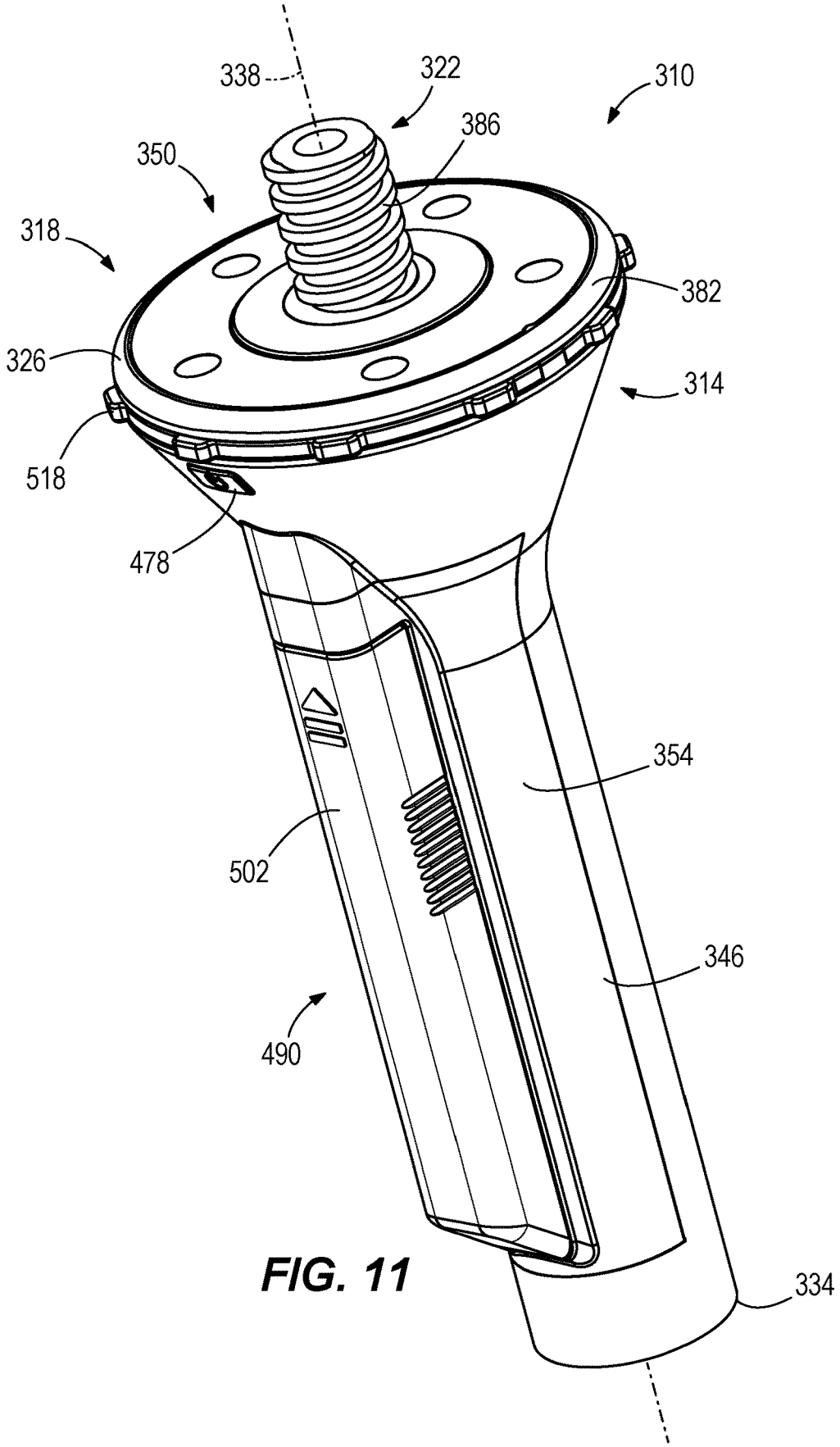
FIG. 11 is a perspective view of the handle adapter assembly of FIG. 8.
Figure 12:
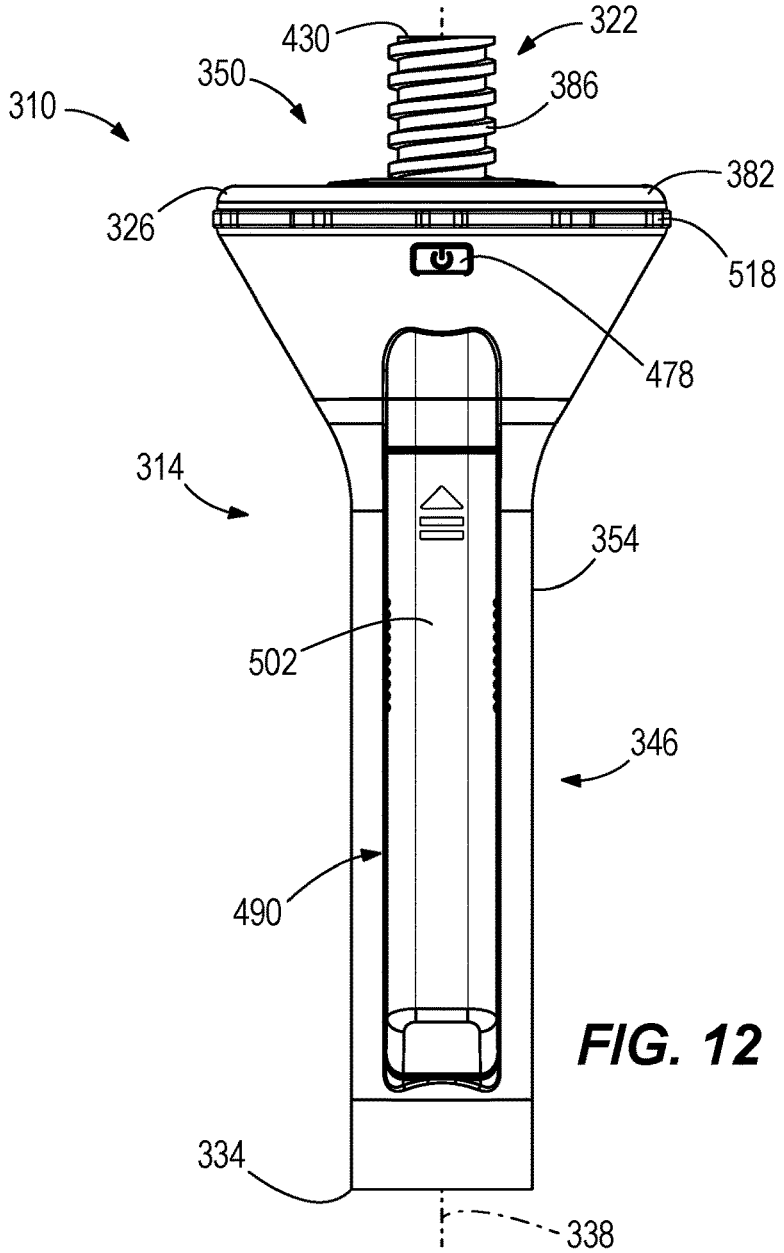
FIG. 12 is a side view of the handle adapter assembly of FIG. 11.
Figure 13:
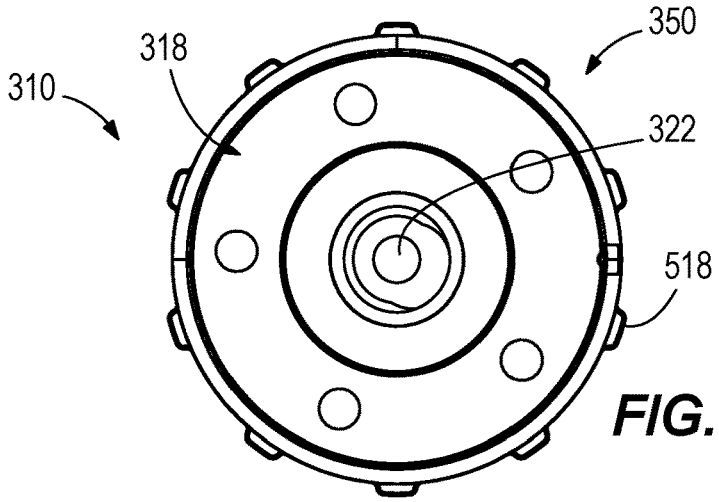
FIG. 13 is a front view of the handle adapter assembly of FIG. 11

The actuator 478 is operatively coupled to the switch 474. The housing 314 defines a second opening 410 (FIG. 14) positioned proximate the switch 474. The actuator 478 extends radially through the second opening 410. The actuator 478 is partially exposed to an exterior of the housing 314 (FIG. 11). The actuator 478 is engageable by a user for adjusting the switch assembly 470 between an on state and an off state.

Figure 14:
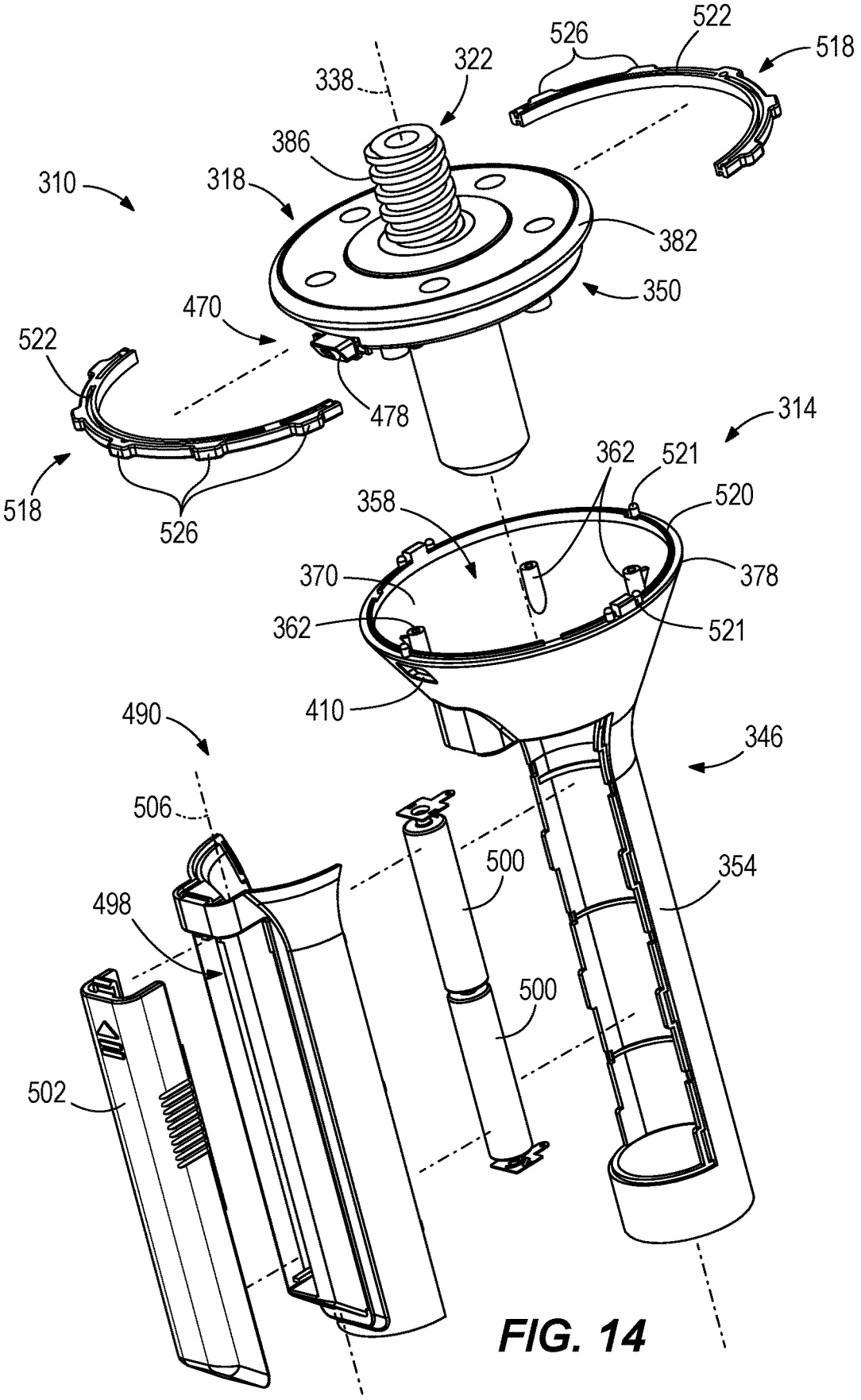
FIG. 14 is an exploded view of the handle adapter assembly of FIG. 11, illustrating a housing having a body and a head assembly.

With reference to FIGS. 11-14, the handle adapter assembly 310 further includes a battery compartment assembly 490. The battery compartment assembly 490 is integrated with the housing 314 of the handle adapter assembly 310. In other words, the battery compartment assembly 490 forms a portion of the outer surface 354 of the housing 314. The battery compartment assembly 490 includes a plurality of receptacles 498 and a door member 502. Each receptacle 498 is configured to receive a battery 500 (FIG. 14). The illustrated battery compartment assembly 490 includes two receptacles 498. In other embodiments, the battery compartment assembly 490 may include one or more receptacles 498.

Each receptacle 498 extends along a receptacle axis 506. Each receptacle axis 506 is aligned with each other. In addition, the aligned receptacle axes 506 extend parallel to the longitudinal axis 338 of the housing 314. In other embodiments, the handle adapter assembly 310 may include one or more battery compartment assemblies 490 integrated with the housing 314.

The door member 502 (FIG. 14) is releasably coupled to the housing 314 of the handle adapter assembly 310. The door member 502 is positioned radially outward of the receptacles 498 of the battery compartment assembly 490 relative to the longitudinal axis 338. The door member 502 selectively encloses the plurality of receptacles 498 of the battery compartment assembly 490. The door member 502 is slidably coupled to the housing 314. More specifically, the door member 502 is slidable in direction parallel to the longitudinal axis 338 (e.g., downward from the frame of reference of FIG. 12) for allowing a user to access the plurality of receptacles 498. In other embodiments, the door member 502 may be configured to selectively enclose one or more of the receptacles 498.

The switch assembly 470 is configured to selectively control a power supply from the battery compartment assembly 490 (i.e., power source) to the plurality of light sources 454. As such, the switch assembly 470 is configured to selectively control the illumination of the light assembly 318.

Figure 8:
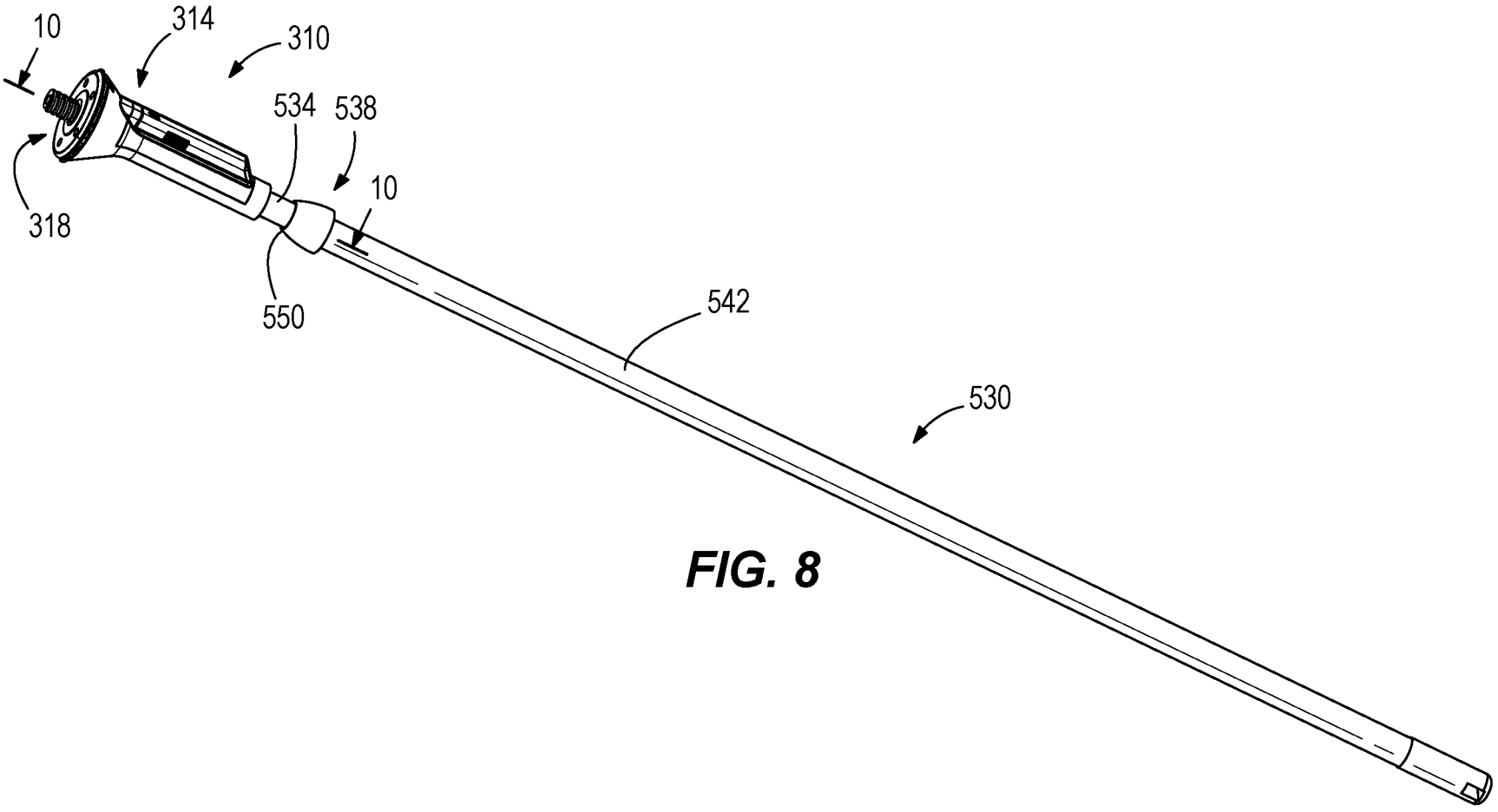
FIG. 8 is a front perspective view of a handle adapter assembly according to a second embodiment, the handle adapter assembly coupled to an extension pole.
Figure 9:
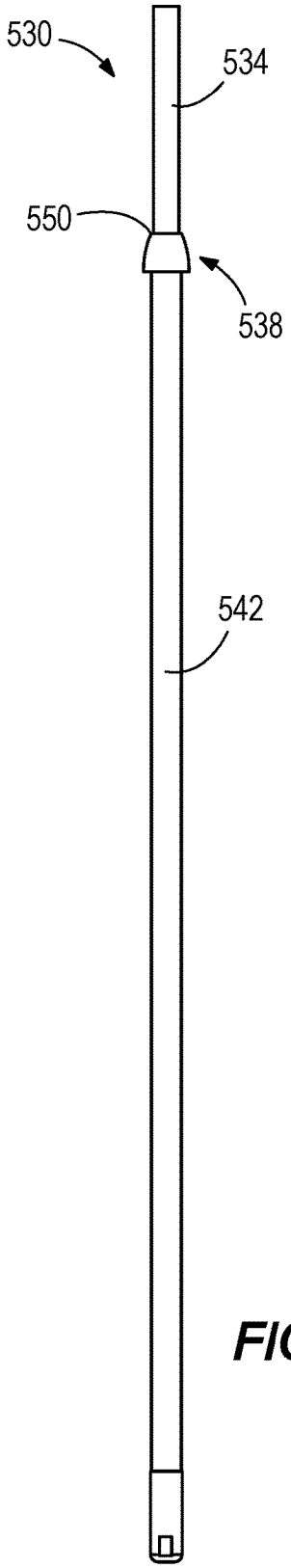
FIG. 9 is a side view of the extension pole of FIG. 8.

With particular reference to FIGS. 8-10, an extension member 530 (e.g., pole) is securely coupled to the handle adapter assembly 310. More specifically, the cavity 358 is configured to receive a first, inner portion 534 of the extension member 530. The inner portion 534 of the extension member 530 abuts against the third portion 428 of the head assembly 350 within the cavity 358 (FIG. 10). In addition, the inner portion 534 of the extension member 530 includes a feature configured to cooperate with the cutout 433 for fixedly coupling the inner portion 534 of the extension member 530 to the housing 314 of the handle adapter assembly 310. In some embodiments, the extension member 530 may be coupled to the connection member 386 and/or the body 346 by adhesives, press-fitting, welding, threading, or the like. As such, unlike the first embodiment of the handle adapter assembly 10 of FIGS. 1-7, the handle adapter assembly 310 does not include a threaded bore portion for removable attachment of the extension member 530.

With continued reference to FIGS. 8-10, the extension member 530 further includes a length adjustment assembly 538. The length adjustment assembly 538 movably couples the inner portion 534 of the extension member 530 to a second, outer portion 542. In particular, the inner portion 534 is received within a chamber 546 (FIG. 10) of the outer portion 542. The length adjustment assembly 538 is positioned at an end 550 of the outer portion 542. Adjustment of the length adjustment assembly 538 is configured to adjust a length of the extension member 530. For example, adjustment of the length adjustment assembly 538 in a first direction is configured to move (e.g., rotate) the outer portion 542 relative to the inner portion 534 such that less of the inner portion 534 is positioned within the chamber 546 of the outer portion 542, thereby increasing the length of the extension member 530.

Various features and advantages of the invention are set forth in the following claims.

What is claimed is:

1. A handle adapter assembly for attaching to a paint applicator, the handle adapter assembly comprising:

a housing having a cover member defining a first end of the housing and a body defining a second end of the housing opposite the first end, the housing including a first connector positioned at the first end, the first connector configured to attach to the paint applicator, the housing also including an outer surface extending between the first end and the second end;

one or more light sources supported by the cover member of the housing;

a power source supported by the body of the housing, the power source electrically connected to the one or more light sources; and a bumper member including a first section received between the housing and the body, and a second section extending outwardly beyond and around a perimeter of the outer surface of the housing.

2. The handle adapter assembly of claim 1, wherein the one or more light sources are positioned at the first end, and wherein the bumper member is positioned to surround the outer surface of the housing proximate the first end.

3. The handle adapter assembly of claim 1, wherein the housing defines a longitudinal axis extending through the first end and the second end, and wherein the bumper member is positioned concentrically with the longitudinal axis on the outer surface.

4. The handle adapter assembly of claim 3, wherein the one or more light sources are positioned concentrically with the longitudinal axis.

5. The handle adapter assembly of claim 1, wherein the first section of the bumper member has an arcuate body and the second section of the bumper member has a plurality of projections extending from the arcuate body, wherein the arcuate body is shaped to compliment the shape of the housing, and wherein the plurality of projections are spaced apart around the arcuate body.

6. The handle adapter assembly of claim 1, wherein the housing defines a longitudinal axis extending though the first end and the second end, and the handle adapter assembly further comprises an annular printed circuit board positioned within the housing, wherein the annular printed circuit board is positioned concentrically with the longitudinal axis and supports the one or more light sources.

7. The handle adapter assembly of claim 6, wherein the first connector includes a threaded stem portion that extends through a center of the annular printed circuit board.

8. The handle adapter assembly of claim 1, wherein the housing further includes a second connector positioned at the second end, and wherein the second connector is configured to attach to an extension pole.

9. The handle adapter assembly of claim 8, wherein one of the first connector or the second connector includes a threaded stem portion, and wherein the other of the first connector or the second connector includes a threaded bore portion.

10. A handle adapter assembly for attaching to a paint applicator, the handle adapter assembly comprising:

a housing having a first end and a second end, the housing defining a longitudinal axis extending through the first end and the second end, the housing including a first connector positioned at the first end, the first connector including a threaded stem portion extending outwardly from the housing and configured to attach to the paint applicator;

an annular printed circuit board supported by the housing and positioned concentrically with the longitudinal axis, the annular printed circuit board defining a central opening through which the threaded stem portion extends;

one or more LEDs positioned on the annular printed circuit board; and a power source supported by the housing, the power source electrically connected to the printed circuit board and to the one or more LEDs.

11. The handle adapter assembly of claim 10, further comprising an annular lens member supported on the first end of the housing and covering the one or more LEDs.

12. The handle adapter assembly of claim 10, further comprising a cover plate member positioned to cover a surface of the printed circuit board, wherein the cover plate member defines one or more holes extending therethrough, and wherein each of the one or more LEDs is receivable in a respective one of the one or more holes.

13. The handle adapter assembly of claim 10, further comprising a switch assembly including a switch and an actuator operatively coupled to the switch, wherein the switch is positioned within the housing and mounted to the printed circuit board, and wherein the actuator is at least partially exposed to an exterior of the housing.

14. A handle adapter assembly for attaching to a paint applicator, the handle adapter assembly comprising:

a housing having a first end and a second end, the housing defining a longitudinal axis extending through the first end and the second end, the first end having a first outer diameter, the second end having a second outer diameter, the first outer diameter being greater than the second outer diameter, the housing tapering from the first outer diameter to the second outer diameter beginning immediately at the first end, the housing including a threaded stem portion positioned at the first end and a threaded bore portion positioned at the second end, the housing defining a cavity;

one or more light sources supported by the housing; and a single battery compartment assembly supported by the housing and positioned within the cavity, the battery compartment assembly including a battery receptacle configured to receive a battery, the battery receptacle extending along a second axis that is angled relative to the longitudinal axis, the single battery compartment assembly electrically coupled to the one or more light sources.

15. The handle adapter assembly of claim 14, wherein the second axis is perpendicular to the longitudinal axis.

16. The handle adapter assembly of claim 14, further comprising a door member movably coupled to the housing, the door member configured to selectively enclose the battery receptacle.

17. The handle adapter assembly of claim 14, further comprising an annular printed circuit board positioned within the housing, wherein the annular printed circuit board is positioned concentrically with the longitudinal axis, and wherein the one or more light sources are positioned on the annular printed circuit board.

18. The handle adapter assembly of claim 17, wherein the threaded stem portion extends through a center of the annular printed circuit board.

19. The handle adapter assembly of claim 14, wherein the threaded bore portion is positioned within the cavity, and wherein the threaded bore portion is positioned concentrically with the longitudinal axis.

20. The handle adapter assembly of claim 14, wherein the second outer diameter is smaller than a length of the battery receptacle.

* * * * *